US009847072B2

(12) United States Patent
Zhou

(10) Patent No.: US 9,847,072 B2
(45) Date of Patent: Dec. 19, 2017

(54) IMAGE STICKING ELIMINATION CIRCUIT AND DISPLAY DEVICE

(71) Applicant: BOE TECHNOLOGY GROUP CO., LTD., Beijing (CN)

(72) Inventor: Liugang Zhou, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 97 days.

(21) Appl. No.: 14/346,574

(22) PCT Filed: Jul. 4, 2013

(86) PCT No.: PCT/CN2013/078835

§ 371 (c)(1),
(2) Date: Mar. 21, 2014

(87) PCT Pub. No.: WO2014/173019

PCT Pub. Date: Oct. 30, 2014

(65) Prior Publication Data

US 2016/0078839 A1 Mar. 17, 2016

(30) Foreign Application Priority Data

Apr. 25, 2013 (CN) ..... 2013 1 0148774

(51) Int. Cl.
*G09G 5/00* (2006.01)
*G09G 3/20* (2006.01)

(52) U.S. Cl.
CPC ..... *G09G 5/003* (2013.01); *G09G 3/20* (2013.01); *G09G 2310/0243* (2013.01);
(Continued)

(58) Field of Classification Search
CPC ..... G09G 5/003; G09G 2310/0251; G09G 2320/04; G09G 2320/0257
See application file for complete search history.

(56) References Cited

U.S. PATENT DOCUMENTS

2004/0104908 A1 6/2004 Toyozawa et al.
2008/0068316 A1* 3/2008 Maekawa ..... G09G 3/3655 345/87
2009/0167668 A1* 7/2009 Kim ..... G09G 3/3677 345/100

FOREIGN PATENT DOCUMENTS

CN 1487494 A 4/2004
CN 102375300 A 3/2012
CN 203179468 U 9/2013

OTHER PUBLICATIONS

International Preliminary Report on Patentability Appln. No. PCT/CN2013/078835; dated Oct. 27, 2015.
(Continued)

*Primary Examiner* — David Tung
(74) *Attorney, Agent, or Firm* — Ladas & Parry LLP; Loren K. Thompson

(57) ABSTRACT

An image sticking elimination circuit comprises signal module (11), switch control module (12) and switch module (13), the signal module (11) has input terminal connected to an enable signal and outputs first control signal according to the enable signal; the switch control module (12) receives the first control signal outputted from the signal module and outputs second control signal; the switch module (13) receives the second control signal outputted from the switch control module (12), and controls the connection or the disconnection between a first electrode (B) and a second electrode (C). By controlling the connection or disconnection of the circuits between the first electrode (B) and the second electrode (C) with the signal module (11), the switch control module (12) and the switch module (13), the charges at the two electrodes are neutralized rapidly by shorting out the first electrode (B) and the second electrode (C) when the display signal is off and the potentials at the two electrodes are equal to eliminate the phenomena of image sticking.

15 Claims, 2 Drawing Sheets

(52) U.S. Cl.
CPC ..... *G09G 2310/0251* (2013.01); *G09G 2320/0257* (2013.01); *G09G 2320/04* (2013.01)

(56) References Cited

OTHER PUBLICATIONS

First Office Action for Chinese Patent Application No. 201310148774.4 dated Jan. 29, 2015; six (6) pages.
English translation of First Office Action for Chinese Patent Application No. 201310148774.4 dated Jan. 29, 2015; five (5) pages.
English abstract of CN102375300A; one (1) page.
English abstract of CN203179468U; one (1) page.
International Search Report for International Application No. PCT/CN2013/078835, 13pgs.

* cited by examiner

IMAGE STICKING ELIMINATION CIRCUIT AND DISPLAY DEVICE

CROSS REFERENCE TO RELATED APPLICATIONS

This application is based on International Application No. PCT/CN2013/078835 filed on Jul. 4, 2013, which claims priority to Chinese National Application No. 201310148774.4 filed on Apr. 25, 2013. The entire contents of each and every foregoing application are incorporated herein by reference.

TECHNICAL FIELD OF THE DISCLOSURE

The present disclosure relates to the field of display device technique, and particularly to an image sticking elimination circuit and a display device.

BACKGROUND

At present, in a display device, particularly in a three-dimensional (3D) product for naked eyes which is switchable between two-dimensional (2D)/three-dimensional (3D) displays, a method of resistance discharging is generally utilized in the discharging loop of a 3D display device, which is to connect the electrode to the ground via a resistor; thus, not only the power consumption is high, but also the discharging time is long, and when switching from the 3D state to the 2D state, since the potential at the first electrode is not equal to that at the second electrode, the phenomena of image sticking in the 3D display device is serious.

SUMMARY

The technical problem to be solved by the embodiments of the present invention is how to eliminate the phenomena of the image sticking in the display device.

To solve the above technical problem, the embodiments of the present invention provide an image sticking elimination circuit which comprises a signal module, a switch control module and a switch module, wherein the signal module has an input terminal connected with an enable signal and is used to output a first control signal according to the enable signal, wherein the switch control module is used to receive the first control signal output by the signal module and to output a second control signal, wherein the switch module is used to receive the second control signal of the switch control module and to control the connection or the disconnection between a first electrode and a second electrode.

Further, the signal module comprises a first field effect transistor (FET) and a first resistor, a gate of the first FET is connected to the enable signal, a drain of the first FET is connected to a first potential, and a source of the first FET is grounded; the first resistor is arranged between the drain of the first FET and the first potential.

Further, the switch module comprises a fourth FET and a fifth FET, wherein a drain of the fifth FET is connected to a first electrode, a source of the fifth FET is connected to a drain of the fourth FET, and a source of the fourth FET is connected to the second electrode Further, a first voltage stabilizing (Zener) diode is arranged between the drain and the source of the fourth FET, and a second voltage stabilizing diode is further arranged between the drain and the source of the fifth FET.

Further, the switch control module comprises a second FET and a second resistor, wherein a gate of the second FET is connected to the drain of the first FET and the gate of the fifth FET, a drain of the second FET is connected to a second potential, and a source of the second FET is connected to a third potential and the gate of the fourth FET; the second resistor is arranged between the source of the second FET and the third potential.

Further, the switch control module comprises a second FET, a third FET and a third resistor, wherein a gate of the second FET is connected to the drain of the first FET, a drain of the second FET is connected to the second potential, and a source of the second FET is connected to a third potential and the gate of the fourth FET; a second resistor is arranged between the source of the second FET and the third potential; a gate of the third FET is connected to the source of the second FET, a source of the third FET is connected to a fourth potential and the gate of the fifth FET, and a drain of the third FET is connected to a fifth potential; the third resistor is arranged between the source of the third FET and the fourth potential.

The embodiments of the present invention further provide a display device comprising the image sticking elimination circuit described above.

In the image sticking elimination circuit and the display device provided in the above technical solutions, the signal module, the switch control module and the switch module are utilized to control the connection or disconnection for the circuit between the first electrode and the second electrode, so that when the display signal is switched off, the electric charges at the two electrodes are neutralized rapidly and the potentials at the two electrodes are equal to each other, by shorting out the first electrode and the second electrode, so as to eliminate the phenomena of image sticking.

Figure 1:
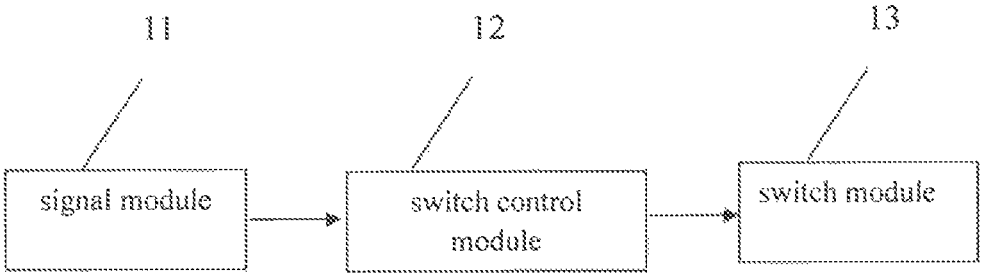
FIG. 1 is a schematic diagram of an image sticking elimination circuit according to an embodiment of the present invention.

The parts represented by those signs in the drawings are as the followings.

11: signal module; 12: switch control module; 13: switch module; B: first electrode; C: second electrode; Q1: first field effect transistor (FET); Q2: second FET; Q3: third FET; Q4: fourth FET; Q5, fifth FET; EN: enable signal; R1: first resistor; R2: second resistor; R3: third resistor; V1: first potential; V2: second potential; V3: third potential; V4: fourth potential; V5: fifth potential.

DETAILED DESCRIPTION

Hereinafter, detailed descriptions will be given to the implementations of the present disclosure in conjunction with the accompanying drawings and the embodiments. The following embodiments are used for illustrating the principles of the present invention instead of limiting the scope of the present invention.

As shown in FIG. 1, the image sticking elimination circuit provided in the embodiments of the present invention comprises a signal module 11, a switch control module 12 and a switch module 13, wherein the signal module 11 has an input terminal connected with an enable signal and is used to output a first control signal according to the enable signal; the switch control module 12 is used to receive the first control signal outputted from the signal module 11 and to output a second control signal; the switch module 13 is used to receive the second control signal outputted from the switch control module and to control the connection or disconnection between a first electrode and a second electrode.

Hereinafter further descriptions are given to the image sticking elimination circuit according to the embodiments of the present invention by illustrating two exemplary embodiments.

First Embodiment

Figure 2:
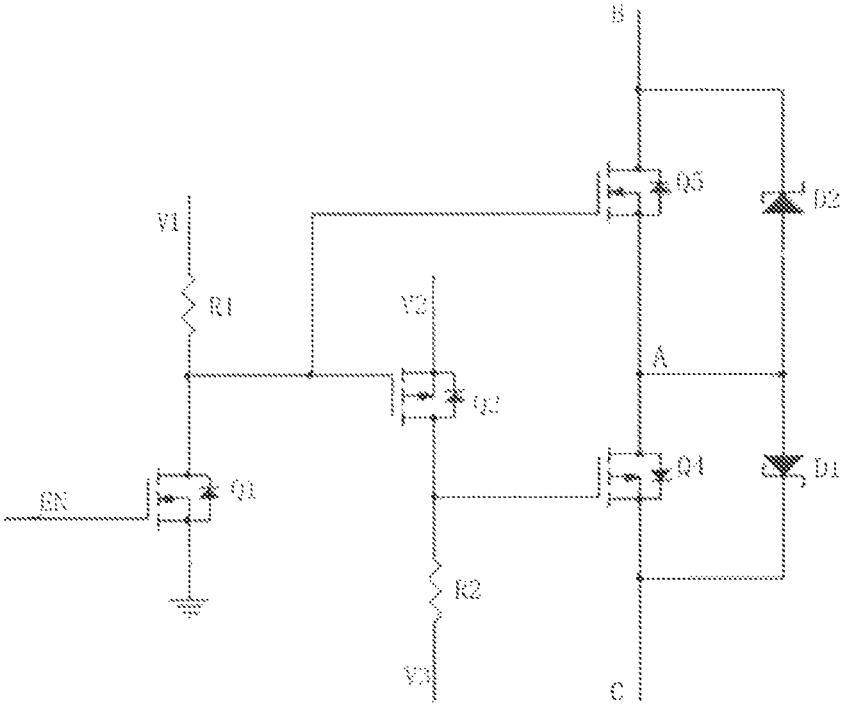
FIG. 2 is a circuit diagram of the image sticking elimination circuit in a first embodiment of the present invention.

As shown in FIG. 2, in the image sticking elimination circuit according to the embodiment of the present invention, the signal module comprises a first field effect transistor (FET) Q1 and a first resistor R1; the switch control module comprises a second FET Q2 and a second resistor R2; and the switch module comprises a fourth FET Q4 and a fifth FET Q5.

The gate of the first FET Q1 is connected with an enable signal EN, the source of the first FET Q1 is grounded, and the drain of the first FET Q1 is connected to a first potential V1; further, the first resistor R1 is arranged between the first potential V1 and the drain of the first FET Q1, and the function of the first resistor R1 is to prevent from occurrence of a short-circuit when the first FET Q1 is turned on.

The drain of the first FET Q1 is further respectively connected to the gate of the second FET Q2 and the gate of the fifth FET Q5, the source of the second FET Q2 is respectively connected to the gate of the fourth FET Q4 and a third potential V3, and the drain of the second FET Q2 is connected to the second potential V2; further, the second resistor R2 is arranged between the source of the second FET Q2 and the third potential V3, and the function of the second resistor R2 is to prevent from occurrence of a short-circuit when the second FET Q2 is turned on.

The source of the fourth FET Q4 is connected to a second electrode C, and the drain of the fourth FET Q4 is connected to the source of the fifth FET Q5; the drain of the fifth FET Q5 is connected to a first electrode B, and the connection point between the drain of the fourth FET Q4 and the source of the fifth FET Q5 is the node A.

Since the diode comprised in an FET transistor (MOS transistor) has a weak capability of stabilizing voltage and is easily broken by a current, a first voltage stabilizing diode D1 is therefore arranged between the drain and the source of the fourth FET Q4; correspondingly, a second voltage stabilizing diode D2 is arranged between the drain and the source of the fifth FET Q5.

Optionally, the first FET Q1 and the fifth FET Q5 are N-type FETs, and the second FET Q2 and the fourth FET Q4 are P-type FETs. Optionally, the first potential V1 is a high frequency potential, the second potential V2 is a high frequency potential, and the third potential V3 is a low frequency potential. Optionally, the first electrode B is a raster electrode, and the second electrode C is a common electrode.

When the 3D display signal is in a working state, the enable signal EN is at a high level, the first FET Q1 as an N-type FET is turned on; at this time, the gate of the second FET Q2 as a P-type FET is grounded, the second FET Q2 is turned on, the potential at the gate of the fourth FET Q4 is the second high potential V2, since the potential at the second electrode C is lower than the second potential V2, the fourth FET Q4 as a P-type FET is turned off, by the effect of the second voltage stabilizing diode D2 and the parasitic diode of the fourth FET Q4, the potential at the node A is not higher than the potential at the second electrode C; and since the gate of the fifth FET Q5 is at a low potential, the fifth FET Q5 as a N-type FET is turned off and the first electrode B and the second electrode C are disconnected.

When the 3D display signal is switched off, the enable signal EN is at a low level, the first FET Q1 is turned off, the potential at the gate of the second FET Q2 is V1, the second FET Q2 is turned off, the potential at the gate of the fourth FET Q4 is V3, since the potential at the second electrode C is higher than V3, the fourth FET Q4 is turned on, and the potential at the node A is the potential at the second electrode; since the potential at the gate of the fifth FET Q5 is V1, the fifth FET Q5 is turned on, and the first electrode B and the second electrode C are connected, so that the electric charges at the two electrodes are neutralized rapidly and the potential at the first electrode B and the potential at the second electrode C are equal, so as to eliminate the phenomena of 3D image sticking.

Second Embodiment

Figure 3:
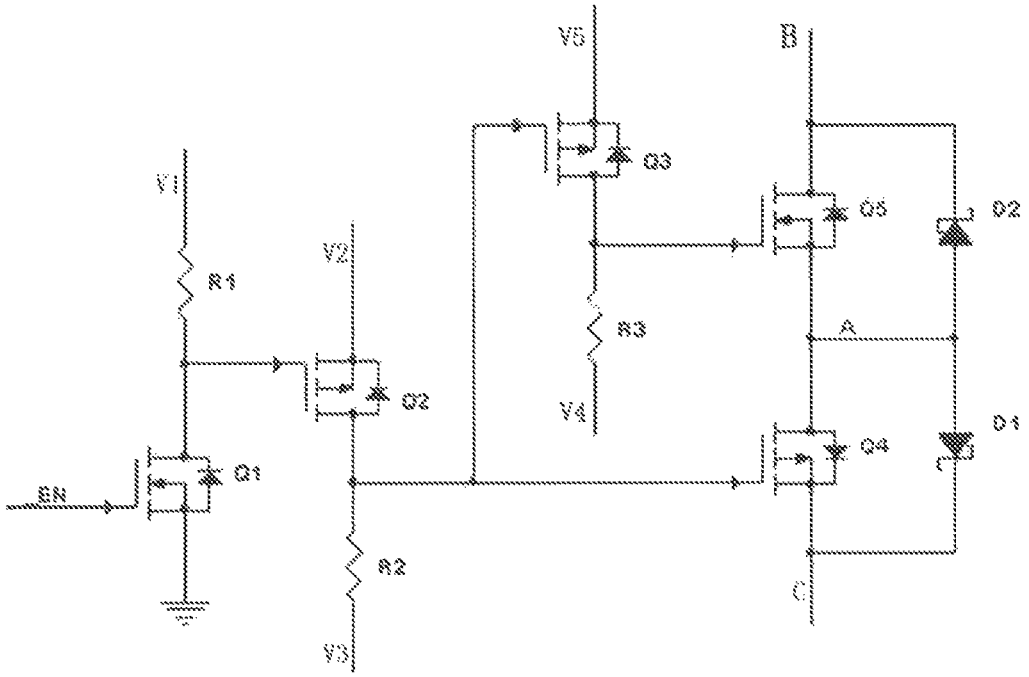
FIG. 3 is a circuit diagram of the image sticking elimination circuit in a second embodiment of the present invention.

As shown in FIG. 3, in the image sticking elimination circuit according to another embodiment of the present invention: the signal module comprises a first field effect transistor (FET) Q1 and a first resistor R1; the switch control module comprises a second FET Q2, a second resistor R2, a third FET Q3 and a third resistor R3; the switch module comprises a fourth FET Q4 and a fifth FET Q5.

The gate of the first FET Q1 connects with an enable signal EN, the source of the first FET Q1 is grounded, and the drain of the first FET Q1 is connected to a first potential V1; further, the first resistor R1 is arranged between the first potential V1 and the drain of the first FET Q1, and the function of the first resistor R1 is to prevent from coming a short-circuit when the first FET Q1 is turned on;

The drain of the first FET Q1 is further connected to the gate of the second FET Q2, the source of the second FET Q2 is connected to the gate of the third FET Q3 and the gate of the fourth FET Q4, the drain of the second FET Q2 is connected to the second potential V2, and the source of the second FET Q2 is connected to the third potential V3, further, the second resistor R2 is arranged between the source of the second FET Q2 and the third potential V3, and the function of the second resistor R2 is to prevent from coming a short-circuit when the second FET Q2 is turned on.

The drain of the third FET Q3 is connected to a fifth potential V5, and the source of the third FET Q3 is connected respectively to the gate of the fifth FET Q5 and a fourth potential V4, further, the third resistor R3 is arranged between the source of the third FET Q3 and the fourth potential V4, and the function of the third resistor R3 is to prevent from coming a short-circuit when the third FET Q3 is turned on;

The drain of the fifth FET Q5 is connected to a first electrode B, and the source of the fifth FET Q5 is connected to the drain of the fourth FET Q4, the source of the fourth FET Q4 is connected to a second electrode C, and the connection point between the drain of the fourth FET Q4 and the source of the fifth FET Q5 is the node A.

Since a diode comprised in an FET transistor (MOS transistor) has a weak capability for stabilizing voltage and is easily broken by a current, a first voltage stabilizing diode D1 is further arranged between the drain and the source of the fourth FET Q4; in addition, a second voltage stabilizing diode D2 is further arranged between the drain and the source of the fifth FET Q5.

Optionally, the first FET Q1 and the fifth FET Q5 are N-type FETs, and the second FET Q2, the third FET Q3 and the fourth FET Q4 are P-type FETs. Optionally, the first potential V1 is a high frequency potential, the second potential V2 is a high frequency potential, the third potential V3 is a low frequency potential, the fourth potential V4 is a low frequency potential, and the fifth potential V5 is a high frequency potential. Optionally, the first electrode B is a raster electrode, and the second electrode C is a common electrode.

When the 3D display signal is in a working state, the enable signal EN is at a high level, the first FET Q1 as an N-type FET is turned on; at this time, the gate of the second FET Q2 as a P-type FET is grounded, and the second FET Q2 is turned on, the potential at the gates of both the third FET Q3 and the fourth FET Q4 are the second high potential V2, since the potential at the second electrode C is lower than the second potential V2, the fourth FET Q4 as a P-type FET is turned off, by the effect of the second voltage stabilizing diode D2 and the parasitic diode of the fourth FET Q4, the potential at the node A is not higher than the potential at the second electrode C; and since the gate of the fifth FET Q5 is at a low potential, the fifth FET Q5 as an N-type FET is turned off and the first electrode B and the second electrode C are disconnected.

When the 3D display signal is switched off, the enable signal EN is at a low level, the first FET Q1 is turned off, the potential at the gate of the second FET Q2 is V1, and thus the second FET Q2 is turned off, the potential at the gates of both the third FET Q3 and the gate of the fourth FET Q4 are V3, since the potential at the second electrode C is higher than V3, the fourth FET Q4 is turned on, the potential at the node A is equal to the potential at the second electrode C; and since the potential at the gate of the fifth FET Q5 is V5, the fifth FET Q5 is turned on and the first electrode B and the second electrode C are connected, so that the electric charges at the two electrodes are neutralized rapidly and the potentials at both the first electrode B and the second electrode C are equal, so as to eliminate the phenomena of 3D image sticking.

The embodiments of the present invention further provide a display device comprising the image sticking elimination circuit according to the above technical solutions.

Specifically, the image sticking elimination circuit and the display device provided in the above technical solutions are applicable to the 3D display technique, wherein the first electrode B is a raster electrode and the second electrode C is a common electrode; the first FET Q1, the fifth FET Q5, the second FET Q2, the third FET Q3, and the fourth FET Q4 are utilized to control the connection and disconnection for the circuits between the first electrode B and the second electrode C, so that when the 3D display is switched off, by shorting out the first electrode B and the second electrode C, the electric charges at the two electrodes are neutralized rapidly and the potentials at the two electrodes are equal, so as to eliminate the phenomena of image sticking.

Those described above are only preferred embodiments of the present disclosure, and it should be noted that for those ordinary skilled in the technical field, a number of improvements and modifications can be made without departing from the principle of the invention, such improvements and modifications should also be considered within the protection scope of the present invention.

What is claimed is:

1. An image sticking elimination circuit comprising a signal module, a switch control module and a switch module, wherein:

the signal module has an input terminal connected with an enable signal and is used to output a first control signal according to the enable signal;

the switch control module is used to receive the first control signal outputted from the signal module, and output a second control signal; and the switch module is used to receive the second control signal outputted from the switch control module, and control the connection or the disconnection between a first electrode and a second electrode, wherein when the enable signal is at a valid level, the first electrode and the second electrode are connected, the first electrode is a raster electrode and the second electrode is a common electrode, wherein, the signal module comprises a first FET and a first resistor, a gate of the first FET receives the enable signal, a drain of the first FET is connected to a first potential, and a source of the first FET is grounded; and the first resistor is arranged between the drain of the first FET and the first potential.

2. The image sticking elimination circuit of claim 1, wherein, the switch module comprises a fourth FET and a fifth FET, a drain of the fifth FET is connected to the first electrode, a source of the fifth FET is connected to a drain of the fourth FET, and a source of the fourth FET is connected to the second electrode.

3. The image sticking elimination circuit of claim 2, wherein, a first voltage stabilizing diode is arranged between the drain and the source of the fourth FET, and a second voltage stabilizing diode is further arranged between the drain and the source of the fifth FET.

4. The image sticking elimination circuit of claim 3, wherein, the switch control module comprises a second FET and a second resistor, a gate of the second FET is connected to the drain of the first FET and the gate of the fifth FET, a drain of the second FET is connected to a second potential, and a source of the second FET is connected to a third potential and the gate of the fourth FET; the second resistor is arranged between the source of the second FET and the third potential.

5. The image sticking elimination circuit of claim 3, wherein, the switch control module comprises a second FET, a second resistor, a third FET, and a third resistor;

a gate of the second FET is connected to the drain of the first FET, a drain of the second FET is connected to a second potential, and a source of the second FET is connected to a third potential and the gate of the fourth FET; the second resistor is arranged between the source of the second FET and the third potential;

a gate of the third FET is connected to the source of the second FET, a source of the third FET is connected to a fourth potential and the gate of the fifth FET, and a drain of the third FET is connected to a fifth potential; and the third resistor is arranged between the source of the third FET and the fourth potential.

6. The image sticking elimination circuit of claim 2, wherein, the switch control module comprises a second FET and a second resistor, a gate of the second FET is connected to the drain of the first FET and the gate of the fifth FET, a drain of the second FET is connected to a second potential, and a source of the second FET is connected to a third potential and the gate of the fourth FET; the second resistor is arranged between the source of the second FET and the third potential.

7. The image sticking elimination circuit of claim 2, wherein, the switch control module comprises a second FET, a second resistor, a third FET, and a third resistor;

a gate of the second FET is connected to the drain of the first FET, a drain of the second FET is connected to a second potential, and a source of the second FET is connected to a third potential and the gate of the fourth FET; the second resistor is arranged between the source of the second FET and the third potential;

a gate of the third FET is connected to the source of the second FET, a source of the third FET is connected to a fourth potential and the gate of the fifth FET, and a drain of the third FET is connected to a fifth potential; and the third resistor is arranged between the source of the third FET and the fourth potential.

8. A display device comprising the image sticking elimination circuit of claim 1.

9. The display device of claim 8, wherein, the signal module comprises a first FET and a first resistor, a gate of the first FET receives the enable signal, a drain of the first FET is connected to a first potential, and a source of the first FET is grounded; and the first resistor is arranged between the drain of the first FET and the first potential.

10. The display device of claim 9, wherein, the switch module comprises a fourth FET and a fifth FET, a drain of the fifth FET is connected to the first electrode, a source of the fifth FET is connected to a drain of the fourth FET, and a source of the fourth FET is connected to the second electrode.

11. The display device of claim 10, wherein, a first voltage stabilizing diode is arranged between the drain and the source of the fourth FET, and a second voltage stabilizing diode is further arranged between the drain and the source of the fifth FET.

12. The display device of claim 11, wherein, the switch control module comprises a second FET and a second resistor, a gate of the second FET is connected to the drain of the first FET and the gate of the fifth FET, a drain of the second FET is connected to a second potential, and a source of the second FET is connected to a third potential and the gate of the fourth FET; the second resistor is arranged between the source of the second FET and the third potential.

13. The display device of claim 11, wherein, the switch control module comprises a second FET, a second resistor, a third FET, and a third resistor;

a gate of the second FET is connected to the drain of the first FET, a drain of the second FET is connected to a second potential, and a source of the second FET is connected to a third potential and the gate of the fourth FET; the second resistor is arranged between the source of the second FET and the third potential;

a gate of the third FET is connected to the source of the second FET, a source of the third FET is connected to a fourth potential and the gate of the fifth FET, and a drain of the third FET is connected to a fifth potential; and the third resistor is arranged between the source of the third FET and the fourth potential.

14. The display device of claim 10, wherein, the switch control module comprises a second FET and a second resistor, a gate of the second FET is connected to the drain of the first FET and the gate of the fifth FET, a drain of the second FET is connected to a second potential, and a source of the second FET is connected to a third potential and the gate of the fourth FET; the second resistor is arranged between the source of the second FET and the third potential.

15. The display device of claim 10, wherein, the switch control module comprises a second FET, a second resistor, a third FET, and a third resistor;

a gate of the second FET is connected to the drain of the first FET, a drain of the second FET is connected to a second potential, and a source of the second FET is connected to a third potential and the gate of the fourth FET; the second resistor is arranged between the source of the second FET and the third potential;

a gate of the third FET is connected to the source of the second FET, a source of the third FET is connected to a fourth potential and the gate of the fifth FET, and a drain of the third FET is connected to a fifth potential; and the third resistor is arranged between the source of the third FET and the fourth potential.

* * * * *